US009518742B2

(12) United States Patent
York et al.

(10) Patent No.: US 9,518,742 B2
(45) Date of Patent: Dec. 13, 2016

(54) PREMIXER ASSEMBLY FOR MIXING AIR AND FUEL FOR COMBUSTION

(71) Applicant: General Electric Company, Schenectady, NY (US)

(72) Inventors: William David York, Greer, SC (US); Thomas Edward Johnson, Greer, SC (US); Christopher Paul Keener, Woodruff, SC (US)

(73) Assignee: General Electric Company, Schenectady, NY (US)

( * ) Notice: Subject to any disclaimer, the term of this patent is extended or adjusted under 35 U.S.C. 154(b) by 332 days.

(21) Appl. No.: 14/094,098

(22) Filed: Dec. 2, 2013

(65) Prior Publication Data

US 2015/0153045 A1 Jun. 4, 2015

(51) Int. Cl.

| | |
|---|---|
| ***F23R 3/10*** | (2006.01) |
| ***F23R 3/28*** | (2006.01) |
| ***F23D 14/62*** | (2006.01) |
| ***F23D 14/64*** | (2006.01) |

(52) U.S. Cl.

CPC ..... *F23R 3/286* (2013.01); *F23D 14/62* (2013.01); *F23D 14/64* (2013.01); *F23R 3/10* (2013.01); *F23R 3/283* (2013.01)

(58) Field of Classification Search

CPC ..... F23R 3/10; F23R 3/283; F23R 3/286; F23D 14/62; F23D 14/64

See application file for complete search history.

(56) References Cited

U.S. PATENT DOCUMENTS

| | | | | |
|---|---|---|---|---|
| 2,967,394 | A * | 1/1961 | Jensen | F23R 3/20 60/737 |
| 8,157,189 | B2 | 4/2012 | Johnson et al. | |
| 8,181,891 | B2 | 5/2012 | Ziminsky et al. | |
| 8,443,607 | B2 * | 5/2013 | York | F23R 3/286 60/39.465 |
| 2006/0156730 | A1 * | 7/2006 | Dinu | F23D 23/00 60/723 |
| 2010/0008179 | A1 * | 1/2010 | Lacy | F23R 3/34 366/134 |
| 2010/0175380 | A1 * | 7/2010 | Davis, Jr. | F23R 3/286 60/734 |
| 2014/0157781 | A1 * | 6/2014 | Moran | F23R 3/14 60/746 |

* cited by examiner

*Primary Examiner* — Gerald L Sung
*Assistant Examiner* — Scott Walthour
(74) *Attorney, Agent, or Firm* — Ernest G. Cusick; Hoffman Warnick LLC

(57) ABSTRACT

A premixer assembly for mixing air and fuel for combustion includes a plurality of tubes disposed at a head end of a combustor assembly. Also included is a tube of the plurality of tubes, the tube including an inlet end and an outlet end. Further included is at least one non-circular portion of the tube extending along a length of the tube, the at least one non-circular portion having a non-circular cross-section, and the tube having a substantially constant cross-sectional area along its length

12 Claims, 7 Drawing Sheets

PREMIXER ASSEMBLY FOR MIXING AIR AND FUEL FOR COMBUSTION

FEDERAL RESEARCH STATEMENT

This invention was made with Government support under Contract No. DE-FC26-05NT42643, awarded by the Department of Energy. The Government has certain rights in the invention.

BACKGROUND OF THE INVENTION

The subject matter disclosed herein relates to turbine systems and, more particularly, to a premixer assembly for mixing air and fuel for combustion within a combustor assembly of a gas turbine engine.

The primary air polluting emissions usually produced by gas turbines burning conventional hydrocarbon fuels are oxides of nitrogen, carbon monoxide, and unburned hydrocarbons. It is well known in the art that oxidation of molecular nitrogen in air breathing engines is highly dependent upon the maximum hot gas temperature in the combustion system reaction zone. One method of controlling the temperature of the reaction zone of a heat engine combustor below the level at which thermal NOx is formed is to premix fuel and air to a lean mixture prior to combustion.

The efficiency of premixing of the fuel and air is an important factor in emissions levels. The length of the tubes used for mixing of the fuel and air is determined by the mixing efficiency. Although longer tubes produce better mixing, lengthening of the tube undesirably necessitates additional cost associated with manufacturing of the tube and increases the overall size of the combustor and the gas turbine engine.

BRIEF DESCRIPTION OF THE INVENTION

According to one aspect of the invention, a premixer assembly for mixing air and fuel for combustion includes a plurality of tubes disposed at a head end of a combustor assembly. Also included is a tube of the plurality of tubes, the tube including an inlet end and an outlet end. Further included is at least one non-circular portion of the tube extending along a length of the tube, the at least one non-circular portion having a non-circular cross-section.

According to another aspect of the invention, a premixer assembly for mixing air and fuel for combustion includes a plurality of tubes disposed at a head end of a combustor assembly. Also included is a tube of the plurality of tubes. Further included is an inlet portion of the tube having a non-circular cross-section. Yet further included is an outlet portion of the tube having a substantially circular cross-section, wherein a cross-sectional area of the tube remains substantially constant over an entire length of the tube. Also included is at least one fuel injection aperture disposed at a fuel injection plane located between an inlet end of the tube and an outlet end of the tube.

According to yet another aspect of the invention, a gas turbine engine includes a compressor section, a turbine section and a combustor assembly. The combustor assembly includes a plurality of tubes disposed proximate a head end of the combustor assembly and configured to mix air and fuel for combustion in a combustion region of the combustor assembly disposed downstream of the plurality of tubes. The combustor assembly also includes a tube of the plurality of tubes including an inlet end and an outlet end. The combustor assembly further includes at least one fuel injection aperture disposed at a fuel injection plane located between the inlet end and the outlet end of the tube. The combustor assembly yet further includes a non-circular portion of the tube having a non-circular cross-section, the non-circular portion located at the fuel injection plane.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
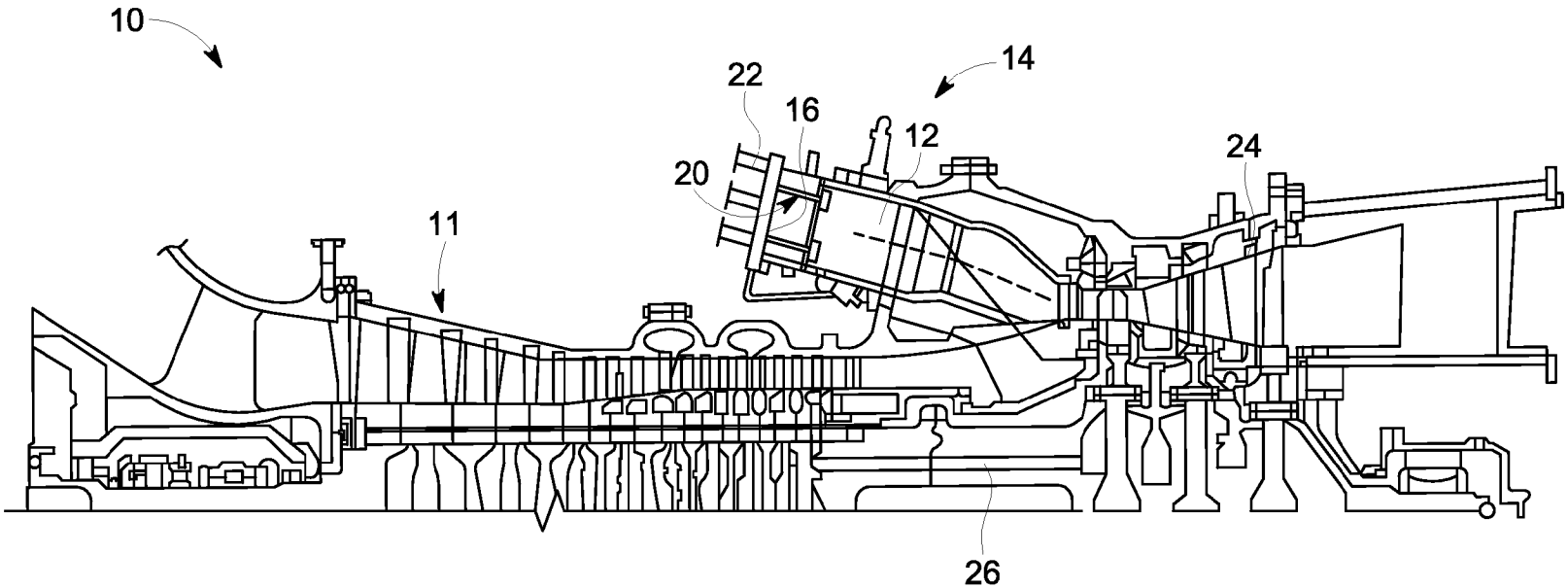
FIG. 1 is a schematic illustration of a gas turbine engine from centerline to outer periphery.

Referring to FIG. 1, a schematic illustration of an exemplary gas turbine engine 10 is shown. The gas turbine engine 10 includes a compressor 11 and a combustor assembly 14. The combustor assembly 14 includes a combustor assembly wall 16 that at least partially defines a combustion chamber 12. A pre-mixing assembly 20 extends from the combustor assembly wall 16 and leads into the combustion chamber 12. The pre-mixing assembly 20 may also be referred to herein as a "premixer assembly." As will be discussed more fully below, the pre-mixing assembly 20 receives a first fluid, such as fuel, through a fuel inlet 22 and a second fluid, such as compressed air, from the compressor 11. The fuel and compressed air are then mixed, passed into the combustion chamber 12 and ignited to form a high temperature, high pressure combustion product or gas stream. Although only a single combustor assembly 14 is shown in the exemplary embodiment, the gas turbine engine 10 may include a plurality of combustor assemblies 14. In any event, the gas turbine engine 10 also includes a turbine 24 and a shaft 26 operatively coupling the compressor 11 and the turbine 24. In a manner known in the art, the turbine 24 is coupled to, and drives the shaft 26 that, in turn, drives the compressor 11.

In operation, air flows into the compressor 11 and is compressed into a high pressure gas. The high pressure gas is supplied to the combustor assembly 14 and mixed with fuel, for example process gas and/or synthetic gas (syngas), in the pre-mixing assembly 20. The fuel/air or combustible mixture is passed into the combustion chamber 12 and ignited to form a high pressure, high temperature combustion gas stream. Alternatively, the combustor assembly 14 can combust fuels that include, but are not limited to natural gas and/or fuel oil. Thereafter, the combustor assembly 14 channels the combustion gas stream to the turbine 24 which coverts thermal energy to mechanical, rotational energy.

Figure 2:
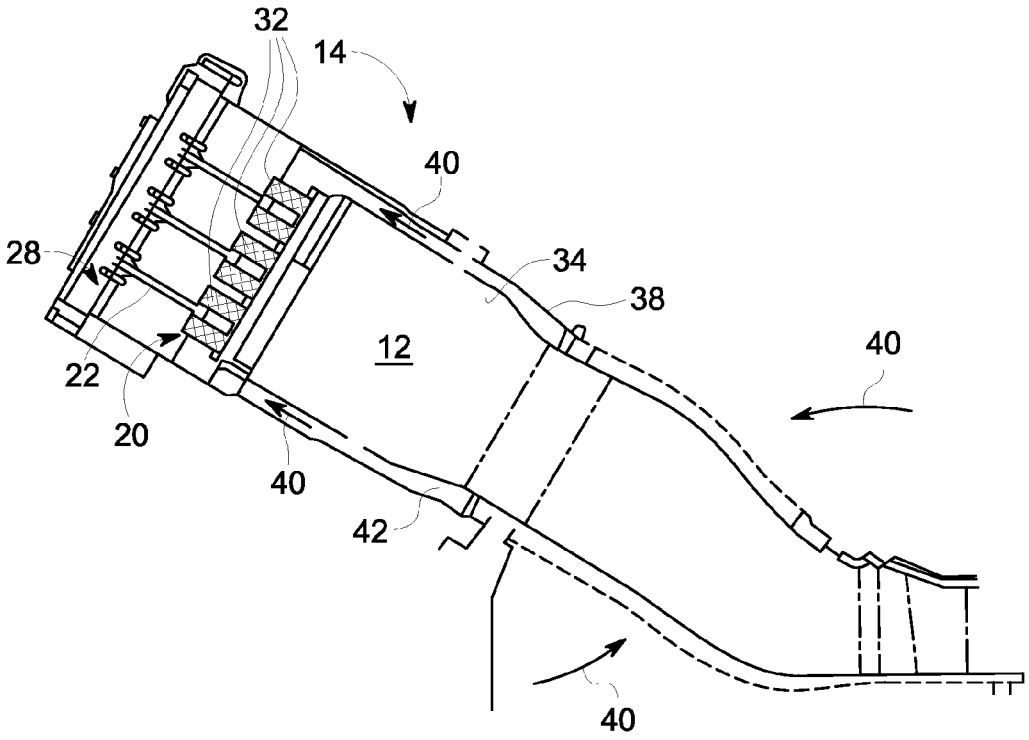
FIG. 2 is a schematic illustration of a combustor assembly of the gas turbine engine.

Referring now to FIG. 2, a can annular array of combustor assemblies is arranged in a circumferentially spaced manner about an axial centerline of the gas turbine engine 10. For illustration clarity, a partial view of a single combustor assembly of the can annular array is shown and includes the combustion chamber 12 and a head end 28. The head end 28 is disposed at an adjacent upstream location of the combustion chamber 12 and includes the pre-mixing assembly 20. The pre-mixing assembly 20 includes a plurality of tubes 32 or pipes that may be appropriated into discrete sections that fit together. In an exemplary embodiment, the pre-mixing assembly 20 includes six sections, with each sector having about 20 to about 200 tubes. However, it is to be understood that the actual number of sections and number of tubes within each section may vary depending on the application of use. Each of the plurality of tubes 32 may vary in dimension. Although referred to throughout the specification as the plurality of tubes 32, it is to be understood that a plurality of passages are employed for a monolithic assembly. Therefore, for clarity of description, the term tube or pipe is referenced herein, but the term is to be understood to be used synonymously with passage.

The combustion chamber 12 is defined by a liner 34, such as an inwardly disposed liner. Spaced radially outwardly of the liner 34, and surroundingly enclosing the liner 34, is a sleeve 38, such as a flow sleeve, for example. An airflow 40 flows in an upstream direction within an annulus 42 defined by the liner 34 and the sleeve 38 toward the head end 28 of the combustor assembly 14. The airflow 40 makes a 180 degree turn into inlets of the plurality of tubes 32 for mixing with a fuel prior to provision of the mixture to the combustion chamber 12.

Figure 3:
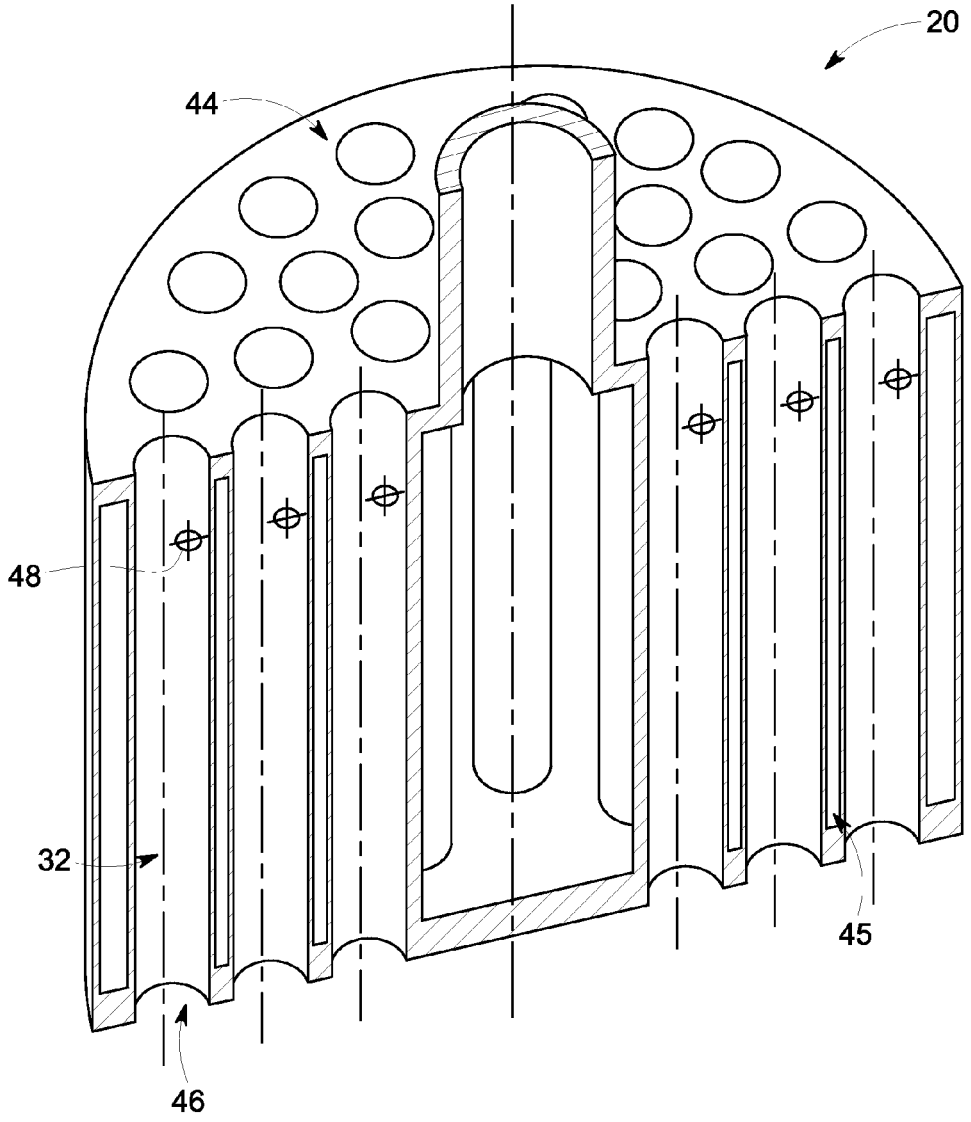
FIG. 3 is a perspective view of a pre-mixing assembly of the combustor assembly.

Referring to FIG. 3, the pre-mixing assembly 20 is illustrated in greater detail. Each of the plurality of tubes 32 of the pre-mixing assembly 20 includes an inlet end 44 and an outlet end 46. Disposed between the inlet end 44 and the outlet end 46 is at least one fuel injection aperture 48 for routing of fuel from a plenum 45 disposed around the tubes 32 to an interior region of each of the plurality of tubes 32. The at least one fuel injection aperture 48 is located at a fuel injection plane between the inlet end 44 and the outlet end 46. As the airflow 40 of compressed air approaches the head end 28 of the combustor assembly 14, it is then turned toward and into the inlet end 44 of each of the plurality of tubes 32. The fuel entering through the at least one fuel injection aperture 48 and the airflow 40 of compressed air entering through the inlet end 44 are mixed within the plurality of tubes 32.

Referring to FIGS. 4-8, multiple embodiments of a tube 50 of the plurality of tubes 32 are schematically shown. In particular, the inlet end 44 of the tube 50 and the outlet end 46 of the tube 50 are illustrated in a stacked arrangement for clarity. The tube 50 of each embodiment includes a non-circular portion 52. The non-circular portion 52 is a non-circular cross-sectional geometry extending along at least a portion of the tube 50. Although the non-circular portion 52 is shown in the illustrated embodiments as being at the inlet end 44 of the tube 50, it is to be understood that the non-circular portion 52 may alternately, or in combination, be disposed at the outlet end 46 of the tube 50 or at an intermediate location between the inlet end 44 and the outlet end 46, as will be described in detail below. Furthermore, the fuel injection apertures 48 are shown at the inlet for illustration purposes, however, it is to be appreciated that the fuel injector apertures are not necessarily located at the extreme inlet end, but rather may be located at some location downstream of the inlet end 44.

In one embodiment, the non-circular portion 52 is disposed proximate the inlet end 44 and extends downstream through the fuel injection plane comprising the at least one fuel injection aperture 48. The non-circular portion 52 then gradually transitions to either a circular cross-section geometry or a different non-circular geometry upstream of the outlet end 46 of the tube 50. As such, the region of the tube 50 proximate the outlet end 46 in the above-described embodiment may be circular or non-circular.

In an embodiment with a non-circular inlet end and outlet end, the tube 50 includes a first non-circular portion located proximate the inlet end 44 and a second non-circular portion located proximate the outlet end 46. The first non-circular portion and the second non-circular portion have distinct cross-sectional geometries. It is contemplated that more than two cross-sectional geometries are included along the length of the tube 50.

In another embodiment, the inlet end 44 and the outlet end 46 are both substantially circular with gradual transitions to the non-circular portion 52, which is located at the fuel injection plane comprising the at least one fuel injection aperture 48.

As will be appreciated from the description below, it is typically advantageous to position the non-circular portion 52 proximate the fuel injection plane, however, in some embodiments, it is contemplated that the inlet end 44 is formed of substantially circular cross-section that extends downstream through the fuel injection plane before gradually transitioning to the non-circular portion 52. The particular type of fuel employed and the desired combustion characteristics of the combustor assembly 14 may result in it being advantageous to gradually transition the circular cross-section to the non-circular portion 52 downstream of the fuel injection plane.

Figure 4:
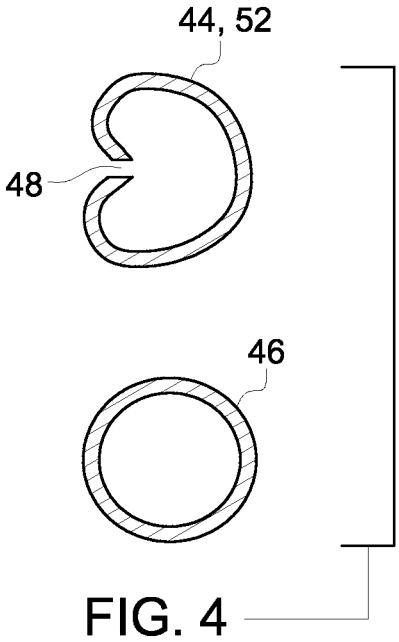
FIG. 4 is a schematic illustration contrasting the geometry of an inlet end and an outlet end of a tube of the pre-mixing assembly according to a first embodiment.
Figure 5:
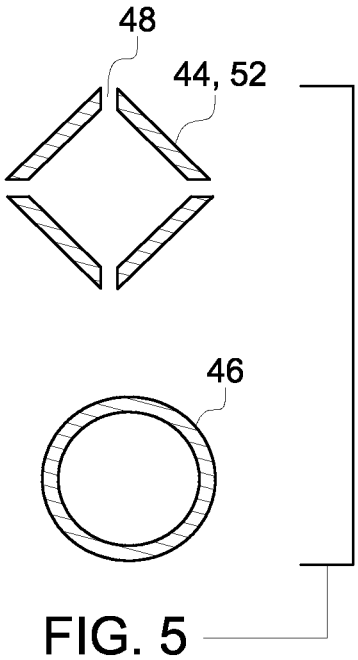
FIG. 5 is a schematic illustration contrasting the geometry of the inlet end and the outlet end of the tube of the pre-mixing assembly according to a second embodiment.
Figure 6:
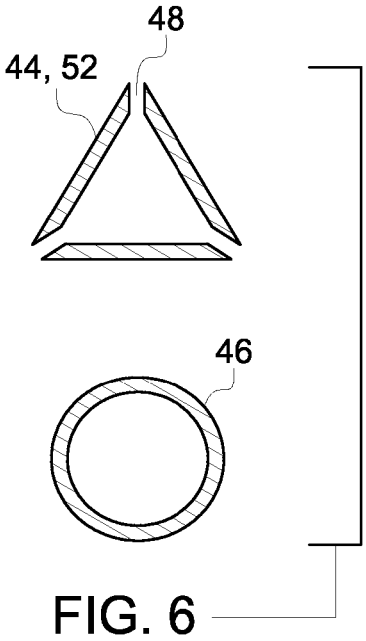
FIG. 6 is a schematic illustration contrasting the geometry of the inlet end and the outlet end of the tube of the pre-mixing assembly according to a third embodiment.
Figure 7:
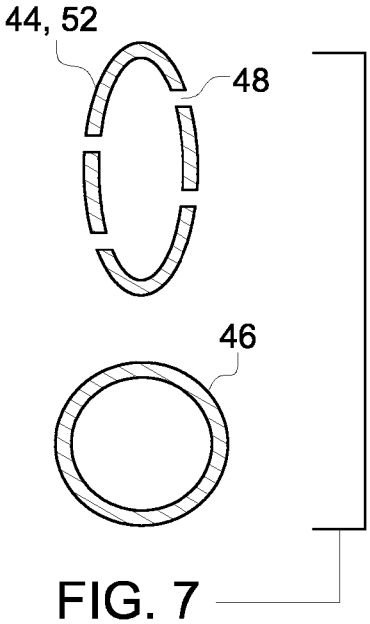
FIG. 7 is a schematic illustration contrasting the geometry of the inlet end and the outlet end of the tube of the pre-mixing assembly according to a fourth embodiment.
Figure 8:
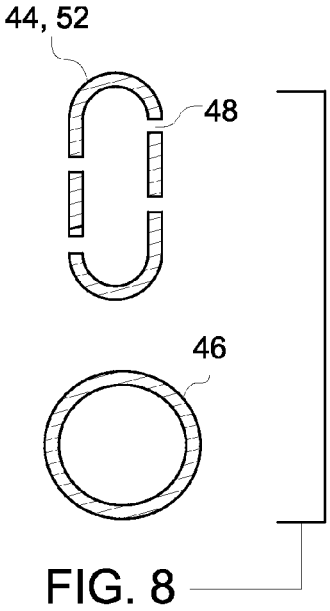
FIG. 8 is a schematic illustration contrasting the geometry of the inlet end and the outlet end of the tube of the pre-mixing assembly according to a fifth embodiment.

Irrespective of the precise location of the non-circular portion 52, or portions, it is to be appreciated that the non-circular geometry may be any non-circular shape. Illustrative embodiments of the non-circular portion 52 are illustrated in FIGS. 4-8. Specifically, a substantially square or rectangular shape (FIG. 5), a substantially triangular shape (FIG. 6), an oval shape (FIG. 7), or "racetrack" or "stadium" shape (FIG. 8) are illustrated. For each illustrated shape, the corners of the quadrilateral or triangle are rounded into a fillet. The illustrated and above-described shapes are merely exemplary and not intended to be limiting. It is to be understood that any non-circular shape may be employed. One particular embodiment found to be particularly advantageous for fuel and compressed air mixing is shown in FIG. 4. The non-circular shape shown is referred to as a substantially cardioid shape. A cardioid is a type of an epicycloid having a single cusp. The cusp is rounded into a fillet.

As expressly noted above, any non-circular shape may be employed for the non-circular portion 52 of the tube 50. Irrespective of where the non-circular portion(s) is located along the length of the tube 50, a gradual transition from a particular geometry (e.g., circular or non-circular) to another is made. In other words, abrupt or rapid transitions are typically avoided in order to reduce or eliminate flow separation and/or significant secondary flows within the tube 50. Although it is contemplated that any conventional manufacturing process may be employed to form the plurality of tubes 32, one category of manufacturing process is particularly useful for forming the gradual shape transitions along the length of the tube 50. In particular, additive manufacturing may be employed to form the tube 50. The term "additively manufactured" should be understood to describe components that are constructed by forming and solidifying successive layers of material one on top of another. More specifically, a layer of powder material is deposited onto a substrate, and melted through exposure to heat, a laser, an electron beam or some other process and subsequently solidified. Once solidified, a new layer is deposited, solidified, and fused to the previous layer until the component is formed. An exemplary additive manufacturing process includes direct laser metal sintering (DMLS).

Figure 10:
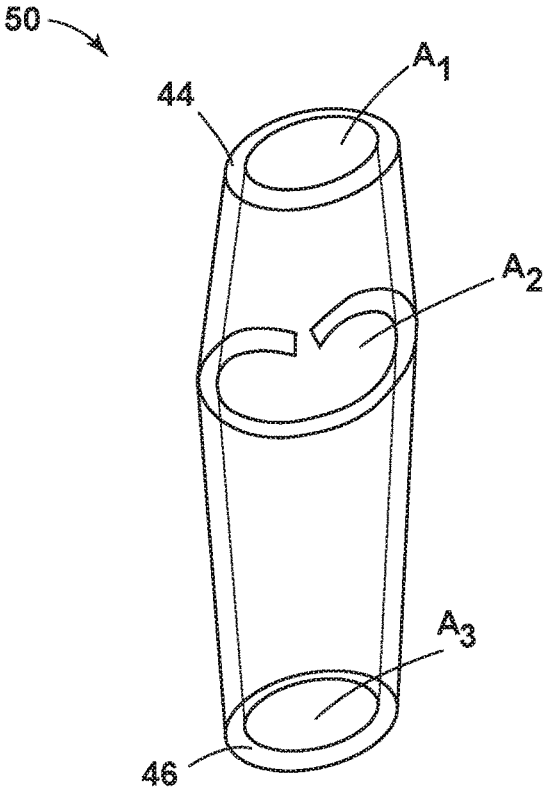
FIG. 10 is a perspective view of the tube illustrating a substantially constant cross-sectional area along the length of the tube.

In all of the above-described embodiments of the tube 50, a substantially constant cross-sectional area is maintained over the majority of the tube 50. More typically, the cross-sectional area is constant over substantially the entire length of the tube 50. Maintaining a constant cross-sectional area over the length of the tube 50 preserves the mean velocity of the fluid(s) within the tube, thereby reducing the likelihood of flashback or flame holding with certain highly-reactive fuels. The constant cross-sectional area is illustrated in FIG. 10, as A1, A2 and A3 represent cross-sectional areas at three locations along the length of the tube 50. A1, A2 and A3 are substantially equal to each other and in the illustrated embodiment, A1 represents the cross-sectional area at the inlet end 44, A2 represents the cross-sectional area at the fuel injection plane and A3 represents the cross-sectional area at the outlet end 46.

Figure 11:
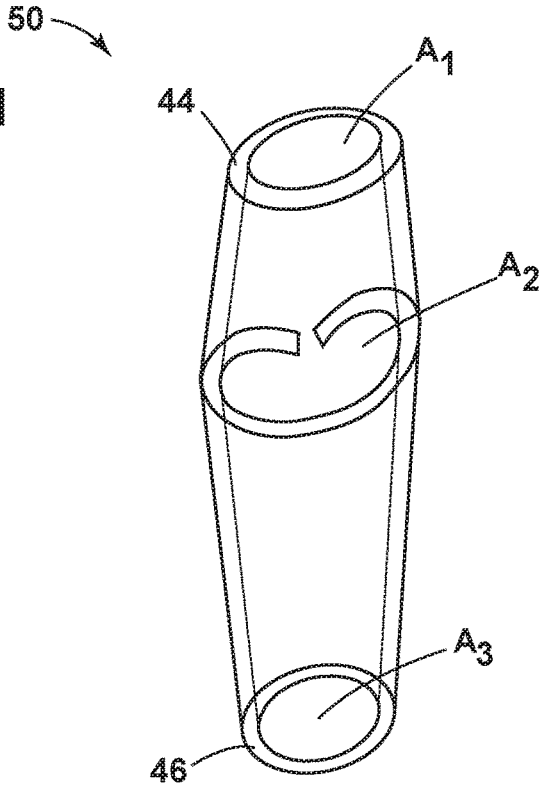
FIG. 11 is a perspective view of the tube illustrating a first non-circular portion of the tube located proximate the inlet end of the tube and a circular portion of the tube located proximate the outlet end of the tube.

FIG. 11 is a perspective view of the tube 50 illustrating a first non-circular portion of the tube 50 located proximate the inlet end 44 of the tube 50 and a circular portion of the tube 50 located proximate the outlet end 46 of the tube 50.

Figure 9:
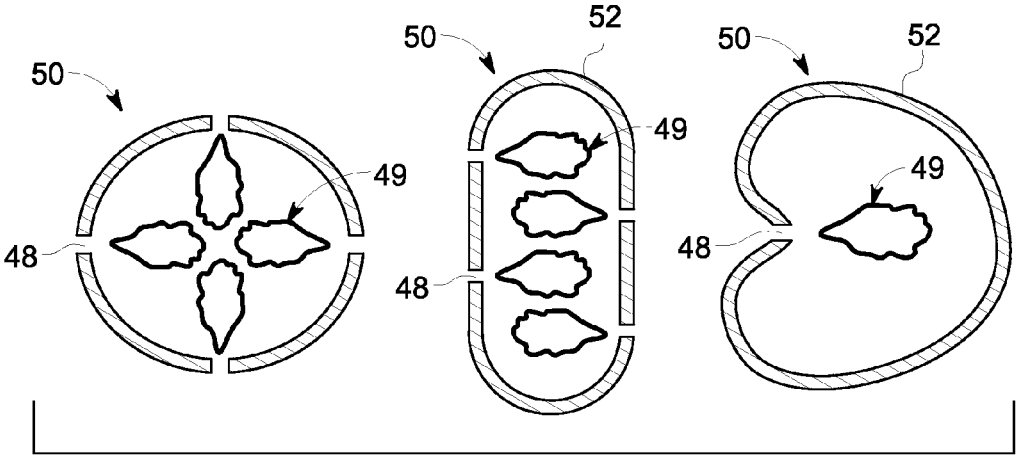
FIG. 9 schematically illustrates fuel injection into various geometric configurations of the tube of the pre-mixing assembly.

In certain embodiments described above, the region of the tube 50 proximate the fuel injection plane includes a non-circular cross-sectional geometry. By avoiding a circular geometry at the fuel injection plane, more efficient mixing of the fuel and the compressed air may be achieved. In particular, a more efficient use of the available interior area of the tube 50 is made by injecting fuel closer to the center of the tube or by distributing fuel injection jets 49 (FIG. 9) over the interior area, thereby leading to more rapid diffusion and/or turbulent mixing of the fuel with compressed air flowing within the tube 50. A comparison between a circular cross-sectional area and exemplary non-circular cross-sectional areas at the fuel injection plane is illustrated in FIG. 9. Non-circular configurations reduce or avoid fuel injection jet coalescence where fuel injection jets 49 are directed at each other. Additionally, the fuel injection jets 49 are not injected directly into a wall. This combination results in a more balanced and/or centered injection of fuel for mixing therein with the compressed air. This type of filling of the tube 50 results in more efficient mixing and may result in lower emissions of oxides of nitrogen, or, alternatively, assist in achieving a shorter tube required for a certain level of emissions, which includes the benefit of smaller, lower-cost components and a lower pressure drop.

As shown, one or more than one fuel injection aperture 48 may be associated with each tube. The precise number of fuel injection apertures will depend on the particular cross-sectional geometry of the tube 50. In certain embodiments, such as the substantially cardioid-shaped tube (FIG. 4), a single fuel injection aperture positioned at the cusp of the cross-sectional shape is advantageous. The other illustrated configurations may benefit from strategic positioning of multiple fuel injection apertures to make efficient use of the available interior area of the tube 50. Regardless of which non-circular shape is employed along a portion of the tube 50, it is to be understood that one or more fuel injection apertures may be included and that the positioning of the fuel injection aperture(s) may vary. For example, although the fuel injection apertures are shown at the fillets of the shapes of FIGS. 5 and 6, some or all of the fuel injection apertures may be positioned along the length of one of the sides of the shapes, such as at a mid-span thereof. An additional benefit of the tube configurations is that the fuel injection apertures are better positioned in the fuel plenum with more space between adjacent tubes. Numerical analysis has indicated that when the fuel aperture inlets are near "open" space in the plenum, and are not opposed the aperture on an adjacent tube, the fuel distribution (and emissions) may be improved.

Advantageously, the above-described embodiments provide more effective and/or rapid mixing of fuel and air in the pre-mixing assembly 20, as well as better distribution of fuel in the fuel injection apertures. As a result, the overall length of the pre-mixing assembly 20 may be reduced while maintaining the same, or better, NOx emissions levels. A shortened assembly also is typically lower in cost and easier to package into the combustor assembly 14, and may lead to lower combustor pressure drop, which can provide an advantage in the efficiency of the gas turbine While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A premixer assembly for mixing air and fuel for combustion comprising:

a plurality of tubes disposed at a head end of a combustor assembly;

a tube of the plurality of tubes, the tube having a longitudinal axis;

an inlet portion of the tube having a non-circular cross-section, the non-circular cross-section being perpendicular to the longitudinal axis at the inlet portion;

an outlet portion of the tube having a substantially circular cross-section, a cross-sectional area of the tube remaining substantially constant over an entire length of the tube, the cross-sectional area defined by a cross-section of the tube perpendicular to the longitudinal axis at the cross-section; and at least one fuel injection aperture disposed at a fuel injection plane located between an inlet end of the tube and an outlet end of the tube, the non-circular cross-section being perpendicular to the longitudinal axis of the at least one non-circular portion of the tube.

2. The premixer assembly of claim 1, wherein the non-circular cross-section extends to a location between the fuel injection plane and the outlet end.

3. The premixer assembly of claim 1, wherein the non-circular cross-section includes a geometry comprising at least one of substantially oval, substantially triangular with fillets at an intersection of edges, substantially quadrilateral with fillets at an intersection of edges, and a pair of semi-circular ends connected by a pair of parallel walls.

4. The premixer assembly of claim 1, wherein the non-circular cross-section includes a geometry comprising a substantially cardioid shape, wherein a cusp of the substantially cardioid shape comprises a fillet.

5. A gas turbine engine comprising:

a compressor section;

a turbine section; and a combustor assembly comprising:

a plurality of tubes disposed proximate a head end of the combustor assembly and configured to mix air and fuel for combustion in a combustion region of the combustor assembly disposed downstream of the plurality of tubes;

a tube of the plurality of tubes including an inlet end and an outlet end;

at least one fuel injection aperture disposed at a fuel injection plane located between the inlet end and the outlet end of the tube;

a non-circular portion of the tube having a non-circular cross-section, the non-circular portion of the tube located at the fuel injection plane, the non-circular cross-section being perpendicular to a longitudinal axis of the non-circular portion of the tube; and at least one circular portion of the tube having a circular cross-section, the at least one circular portion of the tube located proximate the outlet end of the tube, the circular cross-section being perpendicular to a longitudinal axis of the at least one circular portion of the tube, wherein a cross-sectional area of the tube remains substantially constant over an entire length of the tube.

6. A premixer assembly for mixing air and fuel for combustion comprising:

a plurality of tubes disposed at a head end of a combustor assembly;

a tube of the plurality of tubes, the tube including an inlet end, an outlet end, and a longitudinal axis;

at least one non-circular portion of the tube extending along a first length of the tube, the at least one non-circular portion of the tube comprising a first non-circular portion and a second non-circular portion, the first non-circular portion located proximate the inlet end of the tube and having a first non-circular cross-section, the second non-circular portion having a second non-circular cross-section distinct from the first non-circular cross-section, the first non-circular cross-section and the second non-circular cross-section being perpendicular to a longitudinal axis at the at least one non-circular portion of the tube; and at least one circular portion of the tube extending along a second length of the tube, the at least one circular portion of the tube located proximate the outlet end of the tube, the at least one circular portion of the tube having a circular cross-section perpendicular to a longitudinal axis at the at least one circular portion of the tube, wherein a cross-sectional area of the tube remains substantially constant over an entire length of the tube.

7. The premixer assembly of claim 6, further comprising at least one fuel injection aperture disposed at a fuel injection plane located between the inlet end and the outlet end of the tube.

8. The premixer assembly of claim 7, wherein the second non-circular portion extends from a location between the inlet end and the fuel injection plane to a location between the fuel injection plane and the outlet end.

9. The premixer assembly of claim 6, wherein the second non-circular portion is located upstream of the at least one circular portion proximate the outlet end of the tube.

10. The premixer assembly of claim 7, wherein the second non-circular portion is located proximate the fuel injection plane.

11. The premixer assembly of claim 6, wherein the non-circular cross-section comprises a geometry consisting of at least one of substantially oval, substantially triangular with fillets at an intersection of edges, substantially quadrilateral with fillets at an intersection of edges, and a pair of semi-circular ends connected by a pair of parallel walls.

12. The premixer assembly of claim 6, wherein the non-circular cross-section has a substantially cardioid shape, wherein a cusp of the substantially cardioid shape comprises a fillet.

* * * * *